US005518146A

United States Patent [19]

Mattei

[11] Patent Number: 5,518,146

[45] Date of Patent: May 21, 1996

[54] METHOD OF HANDLING DEFOGGING AGENTS USED IN OPERATING ROOMS

[76] Inventor: Glenn M. Mattei, P.O. Box 659, Bunn, N.C. 27508

[21] Appl. No.: 317,184

[22] Filed: Oct. 3, 1994

[51] Int. Cl.[6] ..... B65B 3/04; B65B 31/02; B65D 83/14

[52] U.S. Cl. ..... 222/1; 53/428; 53/470; 141/3; 222/394

[58] Field of Search ..... 222/1, 394; 141/3, 141/20; 53/403, 428, 470; 206/63.5, 438

[56] References Cited

U.S. PATENT DOCUMENTS

| | | | |
|---|---|---|---|
| 3,670,874 | 6/1972 | Brunner | 206/205 |
| 3,763,900 | 10/1973 | Solms-Baruth et al. | 141/3 |
| 4,428,053 | 11/1984 | Alpern et al. | 206/439 |
| 4,615,738 | 10/1986 | Sanders, Jr. et al. | 106/13 |
| 4,757,381 | 7/1988 | Cooper et al. | 206/63.5 X |
| 4,877,016 | 10/1989 | Kantor et al. | 600/109 |
| 4,899,914 | 2/1990 | Schweigl et al. | 222/394 |
| 5,207,213 | 5/1993 | Auhll et al. | 600/104 |
| 5,382,297 | 1/1995 | Valentine et al. | 134/15 |

*Primary Examiner*—Kevin P. Shaver
*Attorney, Agent, or Firm*—John G. Mills and Associates

[57] ABSTRACT

A method of handling defogging agents used in operating rooms. A defogging solution or agent is sterile filtered into an aerosol container that is ergonomically sized to fit the hand of the user. The solution is then capped with a sterile inert gas such as nitrogen as a propellant. The aerosol container is then placed in a pouch and sealed about its periphery. The sealed pouch is then sterilized by gamma radiation. Sterile wipes can also be included in the sterile pouch if desired so that they will be readily available to wipe foreign matter from instruments, masks, glasses and the like, prior to applying the defogging agent. In the operating room, the sterile pouch is opened and discarded and the sterile defogging agent is sprayed on sterile instruments, masks, glasses and other articles to prevent condensation from forming on surfaces due to temperature differential.

10 Claims, 1 Drawing Sheet

METHOD OF HANDLING DEFOGGING AGENTS USED IN OPERATING ROOMS

FIELD OF INVENTION

This invention relates to operating room equipment and procedures and more particularly to delivery systems for defogging agents.

BACKGROUND OF INVENTION

Operating rooms have always included delivery systems for disinfectants, medications, and the like.

As operating equipment has become more sophisticated, the need for more sophisticated delivery systems has arisen.

Instruments such as endoscopes are at room temperature until they are inserted into the body cavity which is some 20 to 25 degrees warmer. This differential causes the lens to fog. One method of overcoming this problem is the use of a vial containing a defogging agent. This agent was disbursed on the endoscope by taking a syringe and inserting the same in the vial and removing the contents. Then the contents are dispersed on the end of the endoscope.

There are a number of problems with this approach to defogging surgical instruments. One of the main problems is that the defogging agent is withdrawn from the vial in the back of the operating room. The syringe is then passed to the sterile field where on numerous occasions the syringe has been mistaken for local anesthetic or medication containing syringes and then accidentally injected into the patient.

Additionally, it is difficult to hit the very small lens of the endoscope with the small stream of defogging agent. Further because of diseases such as hepatitis and AIDS, hospitals are trying not to use syringes whenever possible. Lastly, it is difficult to defog large masks or glasses with a small stream of defogging agent emitted from a syringe.

A second method of delivering defogging agents is the dropper bottle/sponge combination wherein the defogging agent is dropped either directly on the endoscope or on a sponge and then wiped on such endoscope. The longer the patient is undergoing surgery the greater risk of contamination of the sponge. It is also difficult to drop a droplet onto the small lens end of an endoscope. Further the dropper bottles are difficult to hold and manipulate. Finally, once the first drops are dispensed from the bottle, ambient air replaces the solution which contaminates such solution and it is no longer sterile which puts the patient at risk when further solution is dispensed from the dropper bottle.

Sterile wipes have also been used for applying defogging agents. The problem is that only one use per wipe can be made before disposing of the same because of contamination. Also these sterile wipes can not be used for defogging masks and glasses. Because these sterile wipes are a single use item, the cost of the same is extremely high.

Until now, the use of sterile aerosol technology has not been considered a viable delivery system for defogging agents for several reasons. First there are environmental issues associated with chloroflourocarbons CFCs which historically have been the only propellent available. Now with the phasing out of CFCs, it has not been considered economically feasible to develop alternate delivery systems for aerosol defogging agents. Also there are fears of using aerosols in operating rooms that have flammable solutions.

Concise Explanation of References

U.S. Pat. No. 4,757,381 to David H. Cooper et al is considered of interest in that it discloses a medical instrument in the form of a camera that can be sprayed in order to inhibit condensation and thereby prevent fogging. There is no suggestion in this reference that the same could be used in conjunction with an invasive medical instrument such as an endoscope.

U.S. Pat. No. 5,207,213 to Richard A. Auhll et al is considered of interest in that it discloses a laparoscope that includes an irrigating system and air for removal of material. The air is under pressure of 300 mm hg. Although the patent mentions that this could be used for defogging the instrument, each time it is used the surgeon would be unable to see which is extremely dangerous. Also the solution leaves a film which further obscures viewing. Finally, the use of high pressure solutions in the body cavity could cause tissue damage.

U.S. Pat. No. 4,877,016 to Edward A. Kantor et al is considered of interest in that it discloses a video endoscope microscope that uses a gaseous mixture including oxygen as a clearing gas over the objective lens. Again there is both the danger of tissue damage as well as creating a potential exposure situation.

U.S. Pat. No. 4,615,738 to Albert J. Sanders, Jr. et al is considered of interest in that it discloses the use of a silicon solution as a defogging agent, possibly in the form of a sterile aerosol application. With the adverse publicity of silicon relating to breast implants, the use of silicon as a defogger would not today be acceptable for use in an operating room.

U.S. Pat. No. 4,950,706 to Morio Kurasawa is considered of interest in that it discloses an anti fog material including five to thirty percent lead. There is no suggestion that this material be used as a defogging agent in an operating room nor is there any suggestion of a delivery system.

U.S. Pat. No. 4,899,914 to Erwin Schweigl is considered of interest in that it discloses a sterile, preservative free aerosol solution for use in conjunction with contact lens. There is no suggestion of using this saline solution as a defogger and certainly it was not anticipated that it could be used in an operating room environment.

BRIEF DESCRIPTION OF INVENTION

After much research and study into the above mentioned problems, the present invention has been developed to provide an improved delivery system for defogging agents used in operating rooms. This is accomplished by providing an anti-fogging solution that is sterile and non-flammable in a disposable aerosol container using an inert gas as a propellent. This container is sealed in a sterile package until used. The container is ergonomically suitable for the hand of the user and the fine spray is easy to use on both small and large targets such as the lens of endoscopes and masks and glasses. The present invention is quick and easy to use and cannot be accidently confused with surgical syringes or other equipment and devices commonly found in operating rooms.

In view of the above, it is an object of the present invention to provide a method for handling defogging agents used in operating rooms.

Another object of the present invention is to provide a sterile anti-fogging solution with a non-flammable propellant.

Another object of the present invention is to provide a sterile anti-fogging agent in an ergonomic container for use in operating room environments.

Another object of the present invention is to provide a delivery system for defogging agents that is sterile and includes an aerosol container with a spray nozzle and sterile wipes for use in preventing condensation on the lens of endoscopes and similar devices as well as on masks and glasses.

Other objects and advantages of the present invention will become apparent and obvious from a study of the following description and the accompanying drawings which are merely illustrative of such invention.

DETAILED DESCRIPTION OF INVENTION

Figure 1:
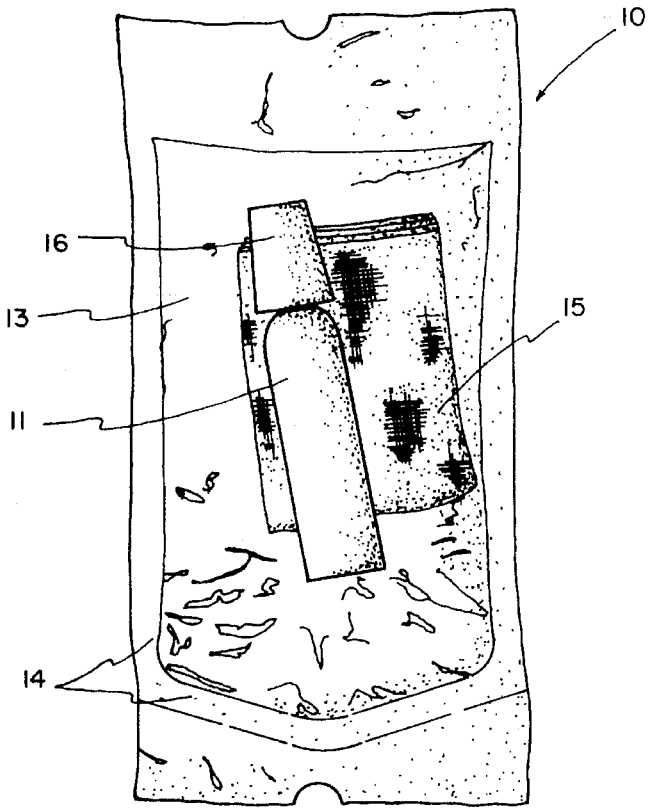
FIG. 1 is a plain view of the present invention in a sterile package.

With further reference to the drawings, the improved delivery system for defogging agents used in operating rooms, indicated generally at 10, includes an aerosol container 11 for the defogging agent with a depressible spray nozzle 12 operatively mounted thereon. Since aerosol containers and their associated spray nozzles are well known to those skilled in the art, further detailed discussion of the same is deemed not necessary.

In the production of the improved delivery system of the present invention, the relatively small, easily held aerosol container 11 is filled with one half ounce of sterile filtered defogging solution in a clean room. The solution is then capped with a sterile inert gas such as nitrogen as a propellent. Next the aerosol container is placed in a sterile pouch 13 and sealed about its periphery as indicated at 14. Finally, the sealed pouch is sterilized by gamma radiation. Sterile wipes 15 are also included in sterile pouch 13 along with aerosol container 11 so that the same will be readily available to wipe foreign matter from the instruments, masks, glasses or the like prior to applying the defogging agent.

Once the improved delivery system for defogging agents of the present invention has been prepared and sterilized as described above, it is ready for shipment to hospitals or other use sites.

In the operating room, the endoscope and/or other instruments to be used are removed from their protective packaging and placed in the sterile field. The sterile pouch 13 is then opened and discarded. Because of the normal 20 plus degree Fahrenheit difference between the ambient temperature of the operating room and the body cavity of the patient, the defogging agent is sprayed on the end of the endoscope or other instrument prior to insertion into the cavity. This prevents condensation from forming on the lens of the instrument due to the temperature differential.

As an alternate method, the defogging solution or agent in container 11 can be sprayed on one of the sterile wipes and then applied to the endoscope or other instrument. These sterile wipes can also be used to removed excess defogging agent. This is particularly useful when defogging masks, glasses and the like.

Use of the sterile defogging agent of the present invention also has the benefit of cleaning the instrument while applying said agent due to the fine spray emitted from the spray nozzle 12.

Figure 2:
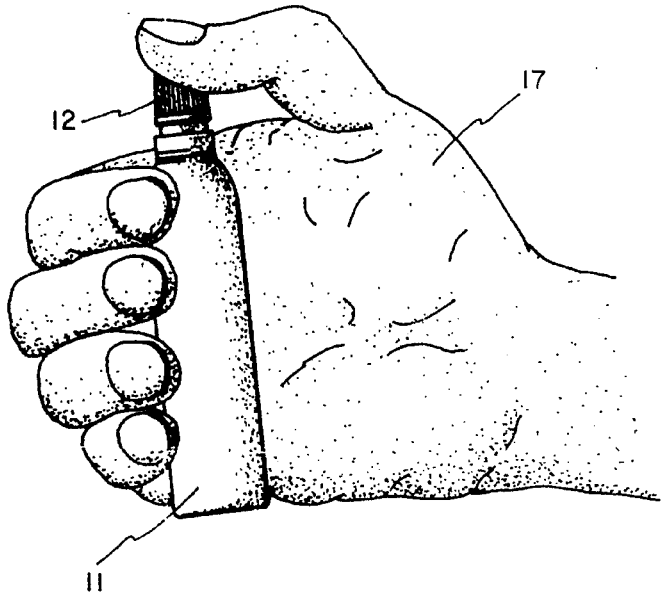
FIG. 2 is an elevational view of the ergonomical container in use.

With the cap 16 removed from the aerosol container 11, the same readily fits in the hand 17 of the user with the thumb comfortably resting on the spray nozzle 12 as clearly shown in FIG. 2. Thus the defogging agent container 11 is ergonomically suited for its intended purpose.

From the above it can be seen that the present invention provides an improved method of handling defogging agents used in operating rooms, is simple and relatively inexpensive, and yet is highly efficient when used.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of handling defogging agents used in operating rooms comprising:

filling an ergonomically-sized aerosol container with sterile defogging solution in a clean room;

capping said solution with a sterile inert gas as a propellant;

placing said container in a pouch;

sealing said pouch;

sterilizing said pouch with radiation;

placing said sterile pouch and its contents in an operating room;

moving said pouch to the sterile field of said operating room; opening said pouch; and spraying said sterile defogging solution on instruments and articles to be defogged.

2. The method of claim 1 wherein the defogging solution is sterile filtered into the container.

3. The method of claim 1 wherein approximately one half ounce of sterile defogging solution is filled into said container.

4. The method of claim 1 wherein sterile wipes are placed in the sterile pouch with the aerosol container.

5. The method of claim 1 wherein said pouch is sterilized with gamma radiation.

6. A method of handling solutions used in operating rooms comprising: filling an ergonomically sized aerosol container with sterile solution in a clean room; capping said solution with a sterile inert gas as a propellant; placing said container in a pouch; sealing said pouch, sterilizing said pouch with radiation; placing said sterile pouch and its contents in an operating room; moving said pouch to the sterile field of the operating room; opening said pouch; and spraying the sterile aerosol solution on instruments and articles in the operating room.

7. The method of claim 6 wherein the solution is sterile filtered into the container.

8. The method of claim 6 wherein approximately one half ounce of sterile solution is filled into said container.

9. The method of claim 6 wherein sterile wipes are placed in the sterile pouch with the aerosol container.

10. The method of claim 6 wherein said pouch is sterilized with gamma radiation.

* * * * *